US007284593B2

(12) United States Patent
Letzel et al.

(10) Patent No.: US 7,284,593 B2
(45) Date of Patent: Oct. 23, 2007

(54) METHOD AND DEVICE FOR EVACUATING DRAINAGE WATER IN THE INNER ARC OF BEAM BLANK CASTING MACHINES

(75) Inventors: Dirk Letzel, Ratingen (DE); Josef Kockentiedt, Duisburg (DE); Thomas Fest, Duisburg (DE); Jürgen Friedrich, Mülheim a. d. Ruhr (DE); Adolf-Gustav Zajber, Langenfeld (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/512,243

(22) PCT Filed: Mar. 11, 2003

(86) PCT No.: PCT/EP03/02470

§ 371 (c)(1),
(2), (4) Date: May 23, 2005

(87) PCT Pub. No.: WO03/090953

PCT Pub. Date: Nov. 6, 2003

(65) Prior Publication Data

US 2005/0211413 A1 Sep. 29, 2005

(30) Foreign Application Priority Data

Apr. 23, 2002 (DE) ..... 102 17 907

(51) Int. Cl.
*B22D 11/124* (2006.01)

(52) U.S. Cl. ..... 164/486; 164/444; 164/5

(58) Field of Classification Search ..... 164/5, 164/486, 444

See application file for complete search history.

(56) References Cited

U.S. PATENT DOCUMENTS 3,800,848 A * 4/1974 Chaulet et al. ..... 164/453
5,915,154 A * 6/1999 Schoch et al. ..... 399/258

FOREIGN PATENT DOCUMENTS

DE 101 22 833 A1 1/2002

OTHER PUBLICATIONS

Patent Abstracts of Japan, vol. 007, No. 282 (M-263), Dec. 16, 1983 & JP 58 157559 A (Mitsubishi Jukogyo KK), Sep. 19, 1983.

* cited by examiner

*Primary Examiner*—Kuang Y. Lin
(74) *Attorney, Agent, or Firm*—Friedrich Kueffner

(57) ABSTRACT

The invention relates to a method for collecting and evacuating run-off water from the inner arc of the strand guide (8) of a beam blank casting machine, according to which the cast strand (2) is solidified and the required dissipation of heat is achieved, among other things, by sprayed water, whereby run-off water can also collect on the inner arc of the strand (2). The run-off water is collected using a suction head (1). The run-off water that is collected in the suction head is fluidized using fluidizers or momentum inhibitors. The fluidized water is sucked off and the water-air mixture is split into water and air in a separation device. The invention also relates to a device for carrying out said method, comprising at least one suction device that is arranged or can be driven along the strand guide (8), said suction device having an attachable suction head (1) and being equipped with fluidizers. The suction device (4) is driven along the beam blank preliminary section (9) by means of manipulators (7).

10 Claims, 1 Drawing Sheet

METHOD AND DEVICE FOR EVACUATING DRAINAGE WATER IN THE INNER ARC OF BEAM BLANK CASTING MACHINES

BACKGROUND OF THE INVENTION

The invention concerns a method for collecting and removing runoff water from the inner arc of the strand guide of a beam blank casting machine, in which the cast strand is solidified, and the necessary heat dissipation is achieved by, among other means, sprayed water, during which operation, runoff water can possibly collect on the inner arc of the strand, this runoff water is collected and sucked up with the use of a suction head, and the water-air mixture that is sucked up is separated into water and air. The invention also concerns a device for carrying out this method.

In beam blank or rail blank casting machines, the cast section is solidified within the strand guide. An outer, solid strand shell already solidifies in the mold by heat conduction to water-cooled copper plates. The beam blank preliminary section is produced in a casting radius.

Further heat dissipation is achieved within the strand guide by roller contact, overspray water, and heat radiation. Excess or runoff water basically collects on the inner arc of the strand and accumulates in greater and greater amounts in the direction of strand offtake as each row of nozzles is passed.

On the one hand, the accumulated water hinders heat transfer by spray cooling, and, on the other hand, it would lead to accumulation of water in front of the oxygen-cutting machine if it were not removed from the web of the strand or the web of the beam blank.

The present state of the art is characterized, for example, by blowing out the water from the inner arc of the strand by compressed air. This blowing requires the use of a large amount of power and is associated with high maintenance costs for the compressors needed to produce the required amounts of compressed air. Furthermore, the uncontrolled water blown over the flange edges of the beam blank preliminary section damages the quality of the section that is produced, which can cause material losses.

The removal of web water from beam blanks by suction is basically already known from the document JP 58[1983]-157,559 A1. According to this document, excess water is picked up by a blade-shaped intake suction tube and sucked out by negative pressure at the end of a discharge tube with a round cross section. The negative pressure is produced by a concentric jacketed tube, by means of which air under pressure flows past the end of the discharge tube, with which it interacts to produce the negative pressure. However, the pressure difference is relatively small and only allows residual cooling water to be sucked up. In addition, an oblique surface for diverting excess cooling water is mounted above the intake suction tube and splits into opposite transverse directions above the intake suction tube, so that residual cooling water runs off to both sides of the cast strand and must be collected separately.

Beam blank sections or blank strands, such as beam blanks or rail blanks, are basically shaped in such a way that residual amounts of water cannot independently flow off over the lateral flange edges. Because the space conditions are already very confined by the conditions in the cooling chamber and within the strand guide, there is not enough room to allow the installation of complicated devices for removing the web water. Diverting the water by suitable devices for feeding it into suction tubes is made extremely difficult by the continuously moving rough strand surface.

The document DE 101 22 833 A describes a suction device for secondary water in blank continuous casting machines. The suction device has a flat suction tube mouthpiece that corresponds to the width of the strand and is operated under negative pressure. A separator for collecting the residual water and impurities that have been sucked in is connected in the exhaust air suction line after the suction tube mouthpiece in the direction of flow.

SUMMARY OF THE INVENTION

Proceeding on the basis of the above state of the art, the objective of the invention is to specify a method and a device that should satisfy the following criteria:

- Catching and collection of runoff water that is as complete as possible in a continuous operation under conditions of continuous casting of steel and removal of runoff water without having a negative effect on the material quality of the cast strand;
- Avoidance of a collision of the cast strand with water-conveying equipment;
- Uncomplicated, space-saving design and low installation expense in the continuous casting plant;
- Low-maintenance and energy-saving suction device for removing runoff water in the inner arc of a continuous casting machine; and
- Use of simple means for adapting the suction device to different strand formats.

In accordance with the invention, to achieve this objective, it is proposed, in a method for collecting and removing runoff water from the inner arc of the strand guide of a beam blank casting machine, that the runoff water collected in the suction head be fluidized with the use of fluidizers or momentum inhibitors, such that fluidizers are designed with a large number of air jets distributed in the suction head, and the suction head is shaped in such a way that a fluidizing chamber is formed for the expansion of the water to be sucked up.

With these measures, the runoff water is fluidized and made pneumatically conveyable within the suction head. Due to the fluidization of the runoff water, the runoff water can be sucked off with the use of only a small amount of power and then fed to a separating device for water and air. The development of a suction head means an uncomplicated and space-saving design, which can be installed in the beam blank casting machine with little expense.

In a further development of the method of the invention, it is proposed that the suction head be guided and/or positioned in or on the strand by means of a manipulator, thereby making it possible to control the suction head from a large distance and from a control room for optimum use.

To seal the suction head from the strand blank or beam blank, it is advantageous to provide sealing devices, such as brushes or rubber sealing strips.

Since beam blank casting machines can be used for different strand formats, in accordance with another proposal of the invention, it is advantageous to design the suction head to be adaptable to different strand formats and to be able to mount it with the use of quick disconnection or connection devices for connection to the suction device.

In accordance with another especially advantageous proposal, the runoff water is sucked off by the suction head in one or more places along the metallurgical length of the cast strand or beam blank below the mold.

The invention also concerns a device for carrying out the method. This device is characterized by fluidizers and means for guiding the suction head along the beam blank preliminary section. With the use of suction heads designed in this way, the runoff water is made pneumatically conveyable, and the water that has been sucked off can be conveyed by the induced draft through suitable tubes or lines to water separators, from which it can be further conveyed or, after suitable purification, returned to the cooling unit of the casting machine.

In a refinement of the device, the suction head is designed in the form of a bell-shaped receiving chamber, which contains the fluidizers, such as nozzles, loose pieces of metal, or chains, for fluidizing the collected water. This arrangement allows a very compact design of the suction head, so that it can be accommodated in the strand guide with a very small space requirement. It is advantageous if suction heads are installed in several regions of the continuous casting plant, so that the runoff water can be sucked off the inner arc of the beam blank in a timely fashion.

An especially advantageous refinement of the suction device provides that the suction head is realized as an exchangeable head by means of quick disconnection and connection devices, so that it can be adapted to other beam blank formats. Since especially in the rolling of girders, different beam blank preliminary sections are used, this proposed measure for adapting the suction head is especially interesting.

Optimized use of the suction device is achieved if a manipulator is provided for positioning the suction head, and the suction head can be positioned at a distance of 0 to 40 mm from the surface of the beam blank section. This measure makes it possible to prevent the suction head from coming into contact with the surface of the beam blank, which can be very rough in individual cases, and thus from damaging either the beam blank itself of the suction head.

Additional refinements of the device of the invention are described in the dependent claims.

Details, features, and other advantages of the invention are described in the following explanation of the embodiment of the invention schematically illustrated in the drawings.

DETAILED DESCRIPTION OF THE INVENTION

Figure 1:
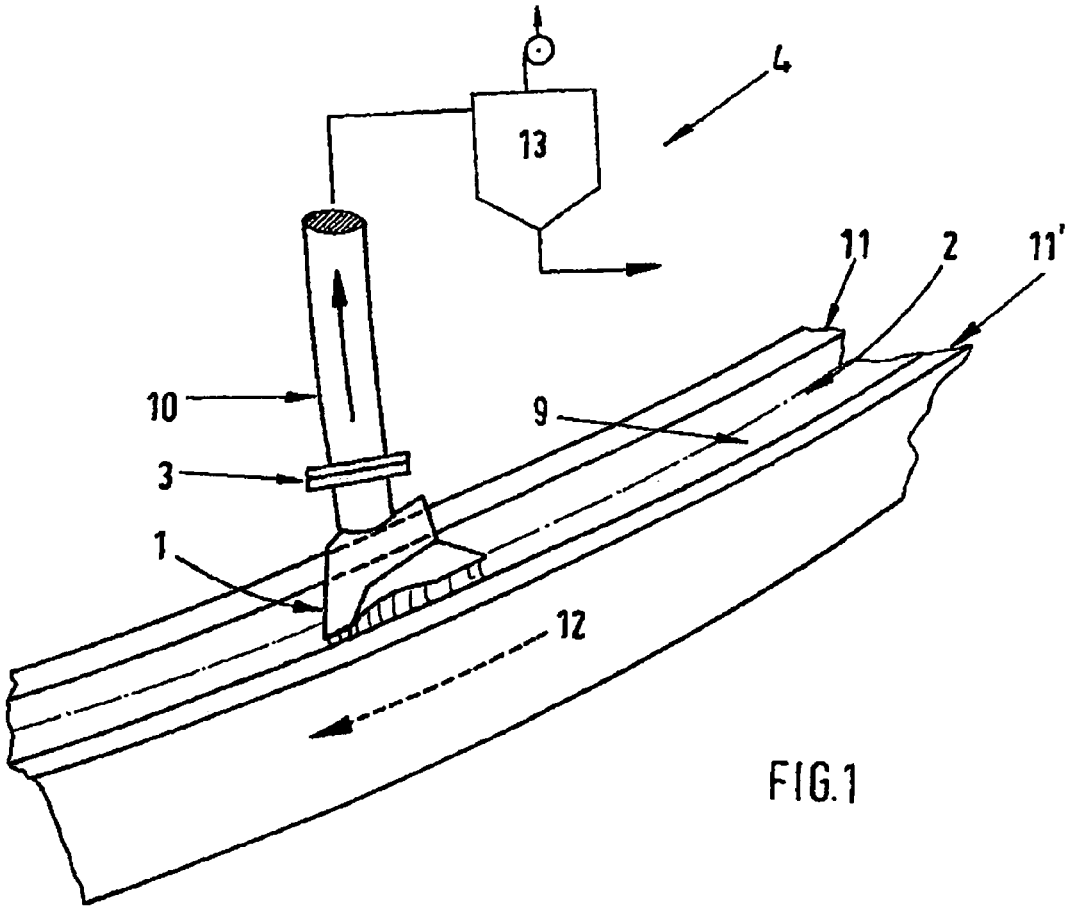
FIG. 1 shows a side view of a strand segment with a suction device for runoff water arranged in the inner arc of the strand guide.

FIG. 1 shows a strand segment of a beam blank, in this case a girder blank. The casting direction of the beam blank is indicated with reference number 12. The lateral edge profiles of the beam blank are labeled with reference numbers 11 and 11'.

the suction head 1 is positioned in the resulting bone-shaped strand section 9 for the purpose of sucking off the excess or runoff water collecting in it. The suction head can be connected to the suction device 4 with quick disconnection or connection devices 3. The suction device consists of the suction line 10 and a water separator 13. The pneumatically conveyable water-air mixture produced in the suction head 1 is removed through the suction line 10, which can be connected to the suction head. As mentioned above, the suction line 10 is connected to a separating device, in which the collected water-air mixture is separated into water and air. The water fraction is then prepared for reuse, i.e., separated from entrained solids and other substances, and returned to the beam blank casting machine to be reused.

The suction head 1 is designed in the shape of a bell with a suction intake at the bottom and encloses a fluidizing chamber for the expansion of the water to be sucked in. In addition, the inside of the suction head 1 is provided with so-called fluidizers or momentum inhibitors for fluidizing the runoff water collected in the suction head and making it pneumatically conveyable. The fluidization of the collected runoff water is preferably improved by providing air jets distributed in the suction head inside the bell-shaped fluidizing chamber for the purpose of expanding the water to be sucked in. The air jets produce powerful turbulence in the collected water, which makes it pneumatically conveyable. The fluidizers can also comprise chains or similar mechanical devices.

Figure 2:
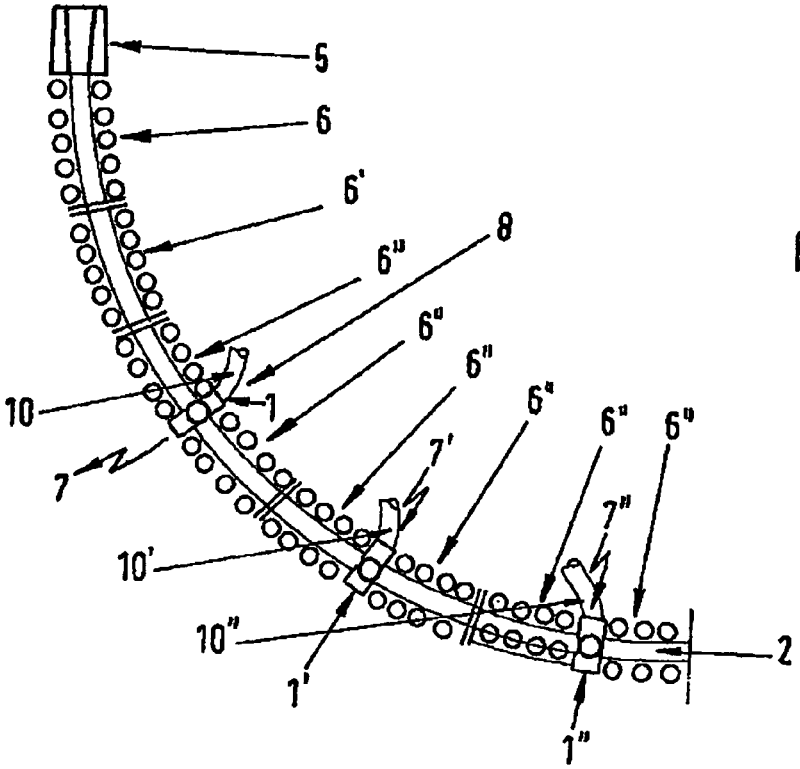
FIG. 2 shows a side view of the strand guide with associated suction devices.

As FIG. 2 shows, the strand guide 8 comprises a mold and a series of strand guide segments 6, 6', 6" to 6$^{n}$ below it. To guide and/or position the suction head, manipulators 7, 7', 7" are provided, as shown purely schematically in FIG. 2. These manipulators can be driven by electric or electromagnetic pulses in such a way that the same distance is always maintained between the suction head 1 and the strand section 9 of the strand guide 8 as the runoff water is being sucked in. This distance is preferably 0-40 mm from the surface of the strand.

The suction head 1 fits flexibly against the strand 2 by means of brushes (not shown). Different suction heads 1, which are to be adapted to different formats of the beam blank preliminary section 9, can be coupled with the suction line 10 by means of a quick disconnection or connection device.

The invention claimed is:

1. Method for collecting and removing runoff water from an inner arc of a strand guide of a beam blank casting machine, in which a cast strand (2) is solidified, and necessary heat dissipation is achieved at least by sprayed water, during which operation, runoff water can possibly collect on the inner arc (9) of the strand (2), the method comprising the steps of: collecting the runoff water; sucking up the runoff water with a suction head; separating the water-air mixture that is sucked up into water and air; and fluidizing the runoff water collected in the suction head (1) using a large number of air jets distributed in the suction head (1), and the suction head being shaped in such a way that a fluidizing chamber is formed for expansion of the water to be sucked up.

2. Method in accordance with claim 1, including at least one of guiding and positioning the suction head (1) in or on the strand (2) with a manipulator.

3. Method in accordance with claim 1, wherein the suction head (1) is designed to be adaptable to different formats of the strand (2) and so that it can be mounted by quick disconnection or connection devices (3) for connection to the suction device (4).

4. Method in accordance with claim 1, including sucking off runoff water with the suction head (1) in at least one place along the metallurgical length of the strand below the mold.

5. Device for the collection and removal of runoff water from an inner arc of a strand guide (8) of a beam blank casting machine with a mold (5) for continuous casting of a beam blank preliminary section (9) and with a strand guide (8), which consists of segments (6-6$^{n}$) and is arranged below the mold (5), the device comprising at least one suction head (1), which is arranged along the strand guide (8) and is connected to a suction device (4), comprising a large number of air jets distributed in the suction head for fluidizing the runoff water collected in the suction head and means (7) for guiding the suction head (1) along the beam blank preliminary section (9).

6. Device in accordance with claim 5, wherein the suction head (1) is a bell-shaped receiving chamber, which contains the fluidizers for fluidizing the collected water.

7. Device in accordance with claim 5, wherein suction heads (1, 1', 1") are installed in several regions of the strand guide (8).

8. Device in accordance with claim 5, wherein the suction head (1) is an exchangeable head having quick disconnection and connection devices (3), so that the suction head can be adapted to other beam blank formats (9).

9. Device in accordance with claim 5, wherein a manipulator is provided for positioning the suction head (1), whereby the suction head (1) can be positioned at a distance of 0-40 mm from the surface of the beam blank section.

10. Device in accordance with claim 5, wherein brushes are provided for sealing and guiding the suction head (1) against the beam blank section (9).

* * * * *